US012709951B1

(12) United States Patent
Ramakrishnan et al.

(10) Patent No.: US 12,709,951 B1
(45) Date of Patent: Aug. 18, 2026

(54) REMOVING METAL CONTAMINANTS FROM DRILLING MUD

(71) Applicant: Saudi Arabian Oil Company, Dhahran (SA)

(72) Inventors: Vijay Ramakrishnan, Houston, TX (US); Richard Pye, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/175,797

(22) Filed: Apr. 10, 2025

(51) Int. Cl.
*E21B 21/06* (2006.01)

(52) U.S. Cl.
CPC ..... *E21B 21/065* (2013.01)

(58) Field of Classification Search
CPC ..... E21B 21/065; E21B 49/005
See application file for complete search history.

(56) References Cited

U.S. PATENT DOCUMENTS 3,498,455 A * 3/1970 Kirby ..... B03C 1/28 210/222
4,463,816 A * 8/1984 MacFarlane ..... G01G 11/04 177/255
6,410,862 B1 * 6/2002 Lecann ..... E21B 21/065 73/152.43
7,642,474 B2 * 1/2010 Calleri ..... G01G 11/00 177/16
8,067,704 B2 * 11/2011 Lowe ..... G01G 11/12 177/121
8,074,509 B2 * 12/2011 Bingham ..... G01G 11/003 73/152.18
8,641,899 B2 * 2/2014 Branch ..... B03C 1/032 210/695

(Continued)

FOREIGN PATENT DOCUMENTS

CN 101603418 A 12/2009
GB 2228215 A * 8/1990 ..... B03B 13/00
RU 2727982 C1 * 7/2020 ..... E21B 29/06

OTHER PUBLICATIONS gnsolidscontrol.com [online], "Ditch Magnet for Drilling Mud," Mar. 2011, retrieved on Apr. 28, 2025, retrieved from URL <https://www.gnsolidscontrol.com/drilling/ditch-magnet-for-drilling-mud/>, 3 pages.

(Continued)

*Primary Examiner* — Jennifer H Gay
(74) *Attorney, Agent, or Firm* — Fish & Richardson P.C.

(57) ABSTRACT

Systems and methods for monitoring and removing metal contaminants from drilling mud are described. This approach can use a system with a ditch magnet, a sensor, and a computer system in electronic communication with the sensor. The sensor is coupled to the ditch magnet and sensor operable to measure at least one characteristic of the ditch magnet associated with an amount of metal material attached to the ditch magnet. The computer system has at least one processor and a memory storing instructions that when executed by the at least one processor causes performance of operations including: determining an amount of metal material attached to the ditch magnet based on the at least one characteristic of the ditch magnet; and triggering an alert when the amount of metal material attached to the ditch magnet exceeds a threshold value.

14 Claims, 6 Drawing Sheets

(56) References Cited

U.S. PATENT DOCUMENTS 8,753,517 B2 * 6/2014 Williamson ..... B03C 1/02 210/695
8,886,504 B2 * 11/2014 Standifird ..... G06G 7/48 166/85.4
9,227,198 B2 1/2016 Branch
9,297,225 B2 * 3/2016 Nesheim ..... E21B 49/005
9,506,337 B2 * 11/2016 Smith ..... E21B 21/066
10,989,646 B1 * 4/2021 Jamison ..... E21B 49/005
11,435,221 B1 * 9/2022 Metcalf ..... E21B 21/01
2008/0196942 A1 * 8/2008 Bingham ..... G01G 11/003 175/46
2008/0250853 A1 * 10/2008 Calleri ..... E21B 21/01 73/152.19
2009/0218145 A1 * 9/2009 Branch ..... B03C 1/30 175/207
2010/0059291 A1 * 3/2010 Lowe ..... G01G 11/12 177/52
2011/0186523 A1 * 8/2011 Williamson ..... B03C 1/0332 210/695
2013/0229286 A1 * 9/2013 Sanchez ..... E21B 47/117 340/853.1
2014/0041860 A1 * 2/2014 Standifird ..... G06G 7/48 166/250.01
2014/0238744 A1 * 8/2014 Nesheim ..... E21B 21/01 175/46
2015/0013448 A1 * 1/2015 Smith ..... E21B 49/005 73/152.46
2015/0159448 A1 * 6/2015 White ..... B03C 1/0332 175/57
2023/0072291 A1 * 3/2023 Korski ..... E21B 21/065
2023/0114032 A1 4/2023 Atkins
2023/0144265 A1 * 5/2023 Bennett ..... B03C 1/0332 210/222
2024/0401427 A1 12/2024 Maher et al.

OTHER PUBLICATIONS magnet4sale.com [online], "24-Inch Ditch Magnet with N52 Neodymium Magnets—8x Stronger and Lighter than Ceramic," retrieved on Apr. 28, 2025, retrieved from URL <https://www.magnet4sale.com/24-inch-ditch-magnet-with-n52-neodymium-magnets-8x-stronger-and-lighter-than-ceramic/>, 4 pages.
nov.com [online], "Bowen Ditch Magnet," retrieved on Apr. 28, 2025, retrieved from URL <https://www.nov.com/products/bowen-ditch-magnet>, 5 pages.
International Search Report and Written Opinion in International Appln. No. PCT/US2026/023259, mailed on Jun. 22, 2026, 14 pages.

* cited by examiner

REMOVING METAL CONTAMINANTS FROM DRILLING MUD

TECHNICAL FIELD

This specification generally relates to drilling wells.

BACKGROUND

An oil well is a drillhole boring in Earth that is designed to bring petroleum oil hydrocarbons to the surface. Usually some natural gas is released as associated petroleum gas along with the oil. A well that is designed to produce only gas may be termed a gas well. Wells are created by drilling down into an oil or gas reserve and if necessary equipped with extraction devices such as pumpjacks. Creating the wells can be an expensive process, costing at least hundreds of thousands of dollars, and costing much more when in difficult-to-access locations, e.g., offshore. The process of modern drilling for wells first started in the 19th century but was made more efficient with advances to oil drilling rigs and technology during the 20th century.

Drilling fluids are used in oil and gas drilling to assist with lubricating the drill bit, ensuring well safety, forming filter cakes to minimize fluid loss into drilling formations, and transporting drill cuttings (such as rock debris) to the surface of the well. As such, drilling fluids are integral to the drilling process. Drilling fluids can include a mixture of various chemicals in a water- or oil-based solution and can be expensive to make. For both environmental reasons and economical reasons, drilling fluid losses can be reduced by stripping drilling fluid away from drill cuttings, so that the drilling fluid can be recovered and reused in the drilling process. The drill cuttings separated from the drilling fluid can be analyzed to determine characteristics of the well.

SUMMARY

This specification describes an approach to monitoring and removing metal contaminants from drilling mud. The associated systems and methods can be used to remove metal contaminants (e.g., fine metallic debris generated by drilling activities) from drilling mud improving safety for personnel and reducing the likelihood of equipment damage. The issue of metal contamination is particularly significant during milling operations which generate cuttings (e.g., during casing exits or section milling).

Ditch magnets are an effective means of trapping and removing metal particles/contaminants from drilling mud to reduce wear on mud pumps and other equipment. They are powerful magnetic tools strategically placed to remove the metal particles/contaminants from the drilling mud. The ditch magnets are typically positioned upstream or downstream of the shale shaker. As the debris builds up on the magnet, the magnetic field reduces at the outer edges, and eventually reaches a point where it does not effectively trap metallic debris anymore. At this point, it needs to be pulled out, cleaned and returned to duty. The frequency of maintenance can be anywhere from once-a-day to several-times-a-day depending on the drilling operation.

The approach disclosed in this specification can be used to measure two key operational parameters of a ditch magnet in service. It can track real-time rate of buildup of metal contaminants on the ditch magnet. By tracking the mass rate of accumulation of metallic contaminants, this approach enables operators to optimize the drilling operation (e.g., milling) being performed. In addition, this approach can track the real-time total buildup of metal contaminants and trigger operators to remove the magnet for cleaning as soon as its efficiency starts waning.

By efficiently removing metal contaminants, this approach reduce the impact of magnetic debris in drilling fluid on downhole logging sometimes used in directional drilling. For example, this can be important in directional drilling in areas close to the magnetic north pole which can be negatively impacted by magnetic particles in the drilling mud. This approach can also improve the effectiveness of ditch magnets in reducing wear on mud pumps and other equipment and reducing the likelihood of injuries to personnel associated with sharp metal fragments (i.e., swarf) in drilling mud.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

This specification describes an approach to monitoring and removing metal contaminants from drilling mud. The associated systems and methods can be used to remove metal contaminants (e.g., fine metallic debris generated by drilling activities) from drilling mud improving safety for personnel and reducing the likelihood of equipment damage. The issue of metal contamination is particularly significant during milling operations which generate cuttings (e.g., during casing exits or section milling).

Ditch magnets are an effective means of trapping and removing metal particles/contaminants from drilling mud to reduce wear on mud pumps and other equipment. The ditch magnets are typically positioned upstream or downstream of the shale shaker. As the debris builds up on the magnet, the magnetic field reduces at the outer edges, and eventually reaches a point where it does not effectively trap metallic debris anymore. At this point, it needs to be pulled out, cleaned and returned to duty. The frequency of maintenance can be anywhere from once-a-day to several-times-a-day depending on the drilling operation.

The approach disclosed in this specification can be used to measure two key operational parameters of a ditch magnet in service. It can track real-time rate of buildup of metal contaminants on the ditch magnet. By tracking the mass rate of accumulation of metallic contaminants, this approach enables operators to optimize the drilling operation (e.g., milling) being performed. In addition, this approach can track the real-time total buildup of metal contaminants and trigger operators to remove the magnet for cleaning as soon as its efficiency starts waning.

Figure 1A:
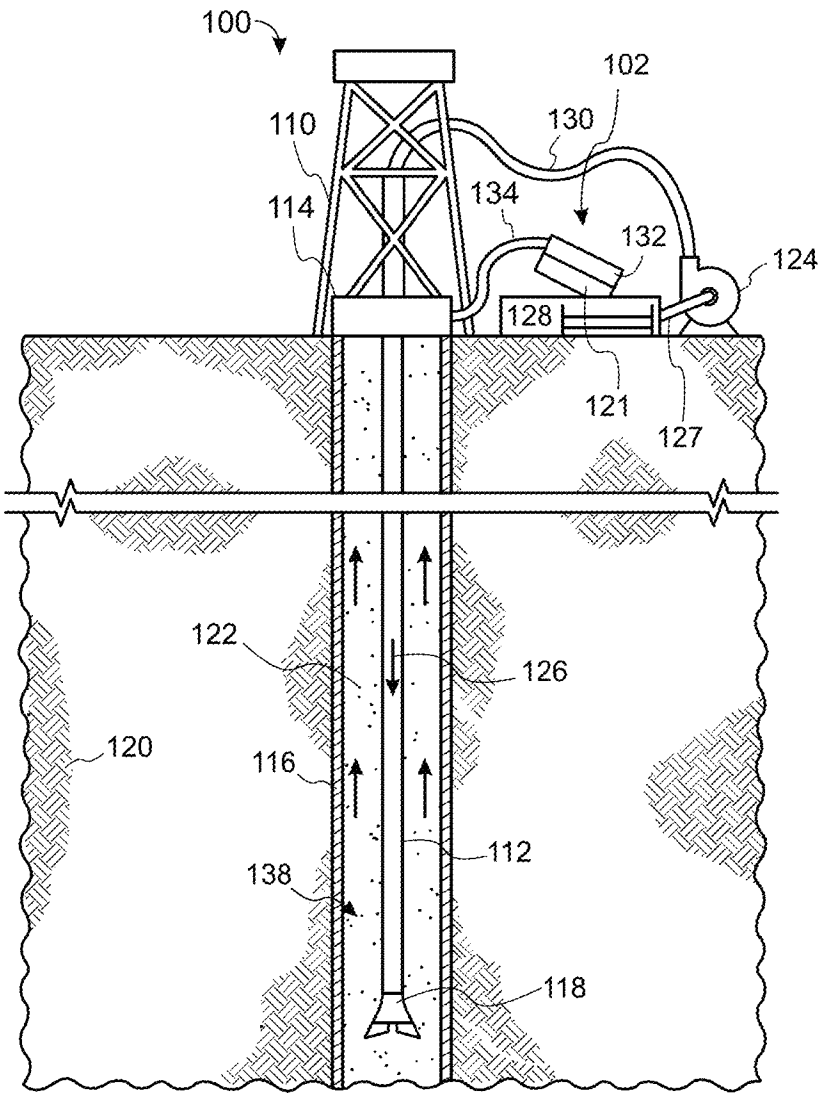
FIGS. 1A-1C are schematic views illustrating drilling operations.
Figure 1B:
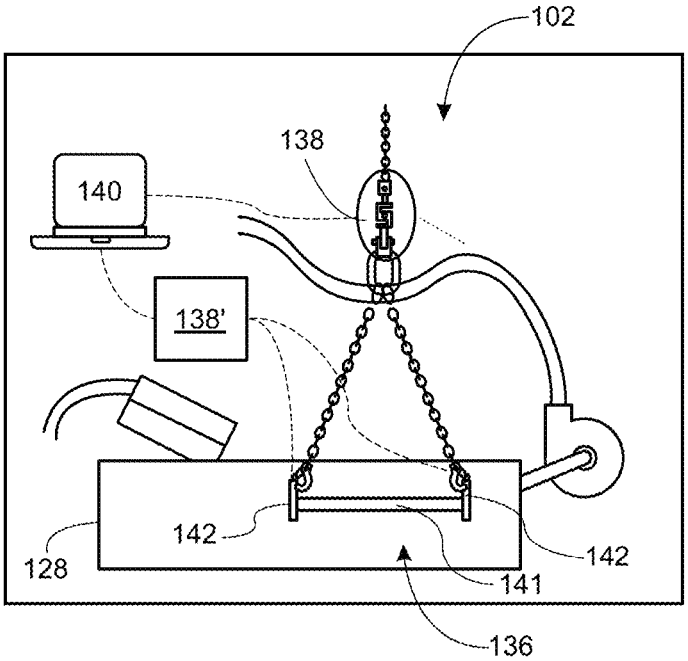
Figure 1C:
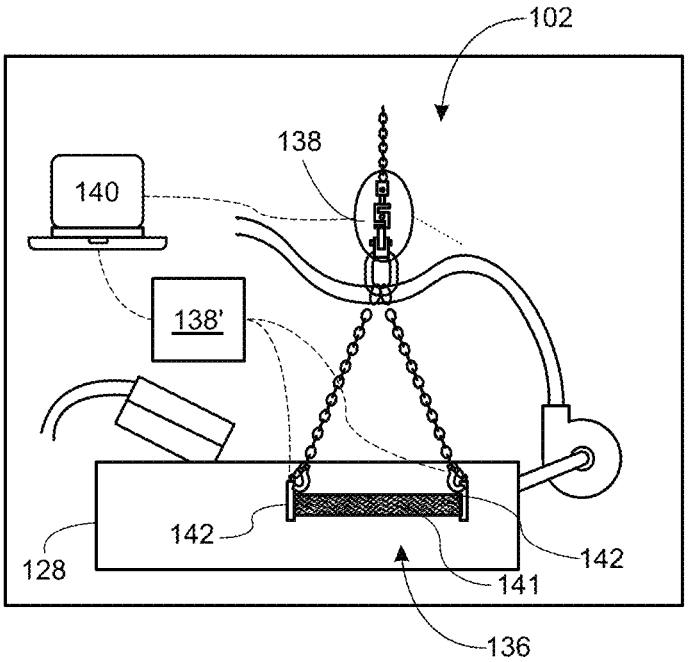

FIG. 1A shows a drilling system 100 including a system 102 for monitoring and removing metal contaminants from drilling mud. FIGS. 1B and 1C are more detailed views of the system 102 as initially deployed or cleaned and after use, respectively.

The drilling system 100 also includes a derrick 110 that supports the weight of and permits selective positioning of a drill string 112 through a blowout preventer 114 at the wellhead of a wellbore 116. The drill string 112 has a downhole end coupled to a drill bit 118 operable to drill the wellbore 116 in a formation 120. To facilitate drilling and removal of drill cuttings 122, a circulation pump 124 circulates drilling fluid 126 though the wellbore 116. An inlet of a circulation pump 124 is coupled to a reservoir for the drilling fluid through a first pipe 127. In the illustrated system, the reservoir is a mud pit 128. In some systems, reservoir can be, for example, a tank or tanks. An pump discharge of the circulation pump 124 is coupled to a top end of the drill string 112 through a second pipe 130. The blowout preventer 114 is coupled to a shaker table 132 through a third pipe 134. The mud pit 128 is coupled to the shaker table 132 and receives the drilling fluid 126 from the shaker table 132.

The system 102 for monitoring and removing metal contaminants from drilling mud includes a ditch magnet 136, sensors 138, 138' coupled to the ditch magnet 136, a computer system 140 in electronic communication with the sensors 138, 138'.

Ditch magnets typically have a magnet encased in stainless steel, with integral handles at each end for lifting. They are typically 2-3 ft long and weigh 30-90 pounds clean and 50-150 pounds with debris. They are often suspended by chains or soft line in the mud ditch or shaker discharge.

The ditch magnet 136 is supported by chains attached to a rig structure above the ditch. In some cases, the magnet is placed on the bottom with a rope attached. (not shown). Although ditch magnets are available in a range of sizes and configurations, the ditch magnet 136 of the system 102 has a central body 141 positioned between a pair of end plates 142. Some systems include other ditch magnets customized to meet the requirements of different fluid volumes and material needs. For example, some ditch magnets include features such as easy installation, quick cleaning mechanisms, and adjustable strengths. The ditch magnet 136 is illustrated as suspended in a return line but can be placed at other locations after the shale shaker discharge.

The sensors are operable to measure at least one characteristic of the ditch magnet associated with an amount of metal material attached to the ditch magnet. The system 102 includes two sensors 138, 138'. One sensor (i.e., the sensor 138) includes a load cell in the line from which the ditch magnet 136 is suspended. The load cell in the sling/line that is carrying the ditch magnet 136 measures the weight of the ditch magnet 136 and any attached debris. The other sensor (i.e., the sensor 138') includes an electrical circuit that measures the electrical resistance between the endplates in real time. The resistance decreases with increasing metallic cross-section (i.e., debris) around the body 141 of the ditch magnet 142. Some systems have more or less than two sensors. For example, some systems use only a load cell or only a circuit sensing electrical resistance.

Although the system 102 is shown with a single ditch magnet 136, some systems have multiple ditch magnets 141. Such systems generally also have multiple sensors and each ditch magnet is associated with at least one of the plurality of sensors. Alternatively, some systems with multiple ditch magnets do not have sensors associated with each of the ditch magnets. Rather debris accumulation on the one or more ditch magnets with associated sensors is assumed to be similar to debris accumulation on ditch sensors without associated sensors.

The computer system 140 includes at least one processor and a memory storing instructions that when executed by the at least one processor causes performance of operations associated with the system 102. In the system 102, the computer system 140 is a laptop computer. Some systems implement the computer system 140 using other combinations of the hardware and software described with reference to FIG. 5. The computer system 140 determines an amount of metal material attached to the ditch magnet 136 based on characteristics of the ditch magnet measured by the sensor(s). Typically, the computer system triggers an alert when the amount of metal material attached to the ditch magnet reaches a set threshold. In some cases, the computer systems 140 also tracks a rate of change in the amount of metal material attached to the ditch magnet. The rate of change in the amount of metal material attached to the ditch magnet can be used to provide input to drilling operations. For example, the rate of debris collected for casing exits is anticipated to be fairly constant as the window is milled out. If the volume increases, it can indicate a failed exit and drilling suspended.

During drilling, the drilling fluid 126 is pumped from the mud pit 128 and flows through the first pipe 127 into the pump suction of the circulation pump 124. The circulation pump 124 then pumps the drilling fluid 126 from the pump discharge to the top end of the drill string 112 through the second pipe 130. Drill cuttings and metallic swarf 139 are carried to the surface by the drilling fluid 126 returning to surface. The fluid exits the wellbore, travels down the flow return line 134 and into the shale shakers 132 where the solids debris is removed from the fluid before re-use. Magnets can be installed prior to the shale shakers to remove the metal particles and larger pieces of swarf that would be damaging to the shaker screens.

Typically, ditch magnets are cleaned several times per day but the required frequency depends on the rate at which debris and particles are being produced. Ditch magnets can be cleaned by removing them from the drilling mud, rinsing them with water, and wiping them down. This cleaning can be performed when the system triggers an alert when the amount of metal material attached to the ditch magnet reaches a set threshold.

Figure 2A:
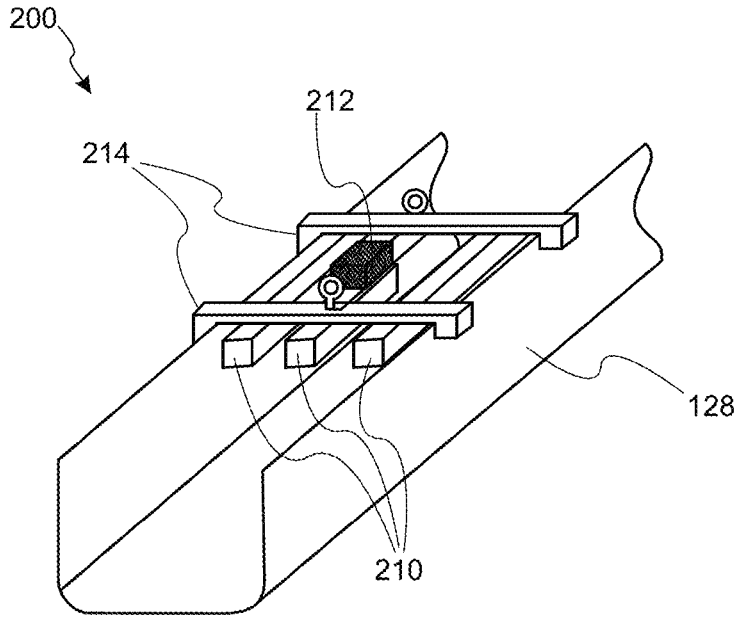
FIGS. 2A and 2B illustrate a system for monitoring and removing metal contaminants present in drilling mud.
Figure 2B:
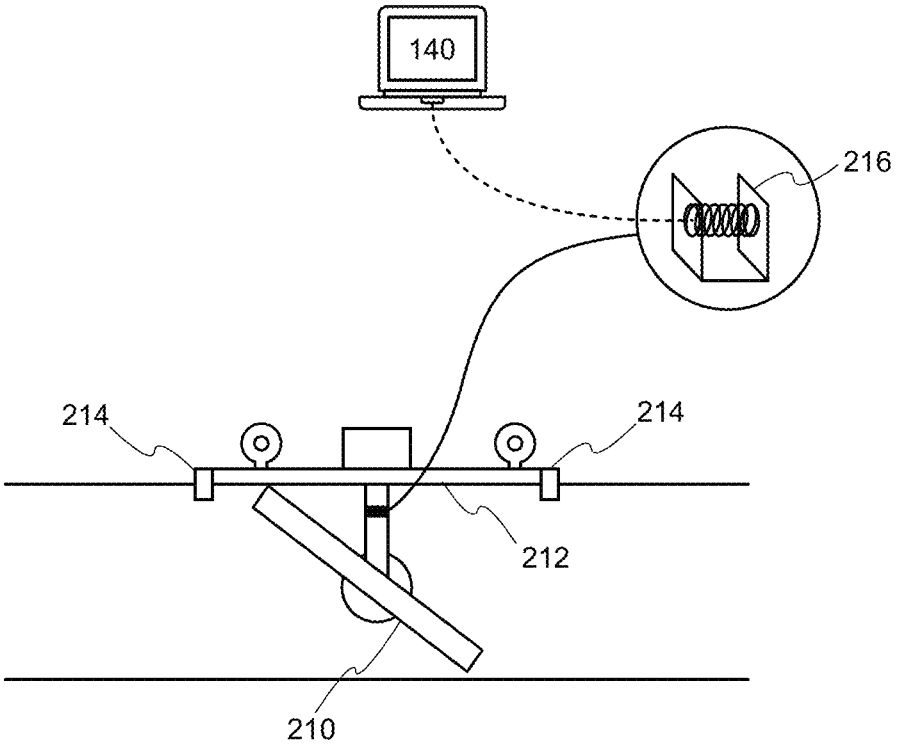

FIGS. 2A and 2B illustrate a system 200 for monitoring and removing metal contaminants present in drilling mud. The system 200 includes multiple ditch magnets 210 suspended in a mud pit 128. Rather than chains, the system 200 includes a hang-off bracket 212 and fixed posts 214 fitted with sensors 216 to measure the load. The multiple ditch magnets 210 can be suspended at various heights to span the cross-section of the flow. This approach also allows tilting of the ditch magnets 210 so they cover a larger proportion of the flow cross-sectional area.

Figure 3:
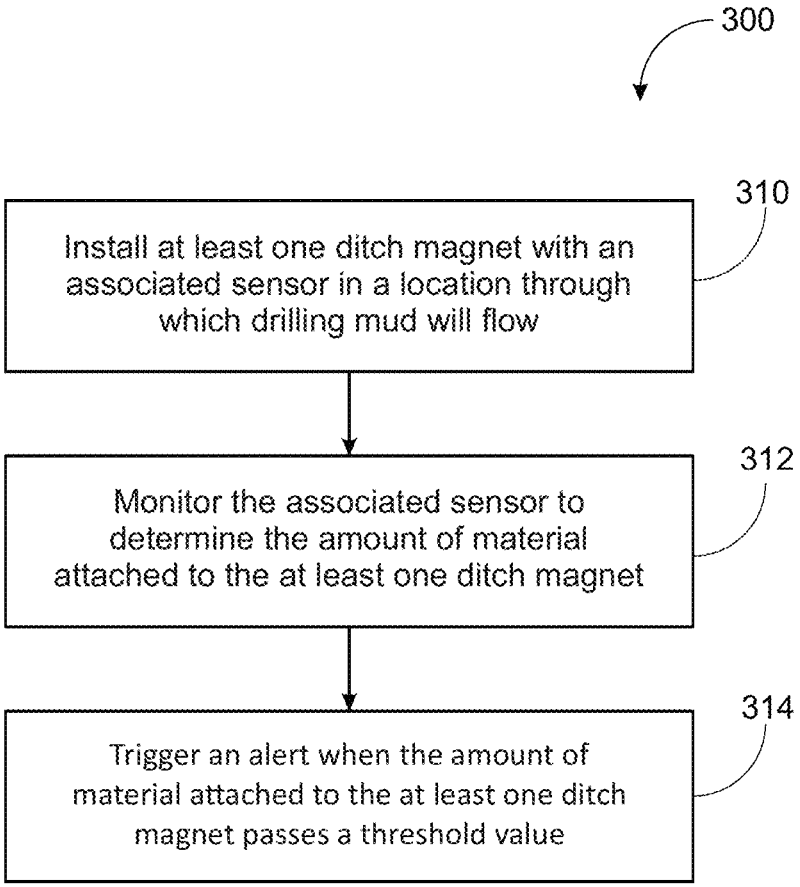
FIG. 3 is a flow chart illustrating a method of monitoring and removing metal contaminants present in drilling mud.

FIG. 3 is a flow chart illustrating a method 300 of monitoring and removing metal contaminants present in drilling mud. The method 300 can be implemented using the system 100, the system 200, or other similar systems.

At least one ditch magnet will be installed in a location through which drilling mud will flow (step 310). A sensor or sensors measure(s) properties of the ditch magnet(s) are used to monitor the amount metal material attached to the ditch magnet(s). For example, appropriate sensors include load cells and circuits measuring electrical resistance. A threshold value is associated with specific ditch magnets and associated sensors. For load cell-based systems, the threshold weight above which a given ditch magnet size/type should be cleaned can be calculated using simple benchtop experiments. Similarly, for resistance-based systems, the resistance below which a given ditch magnet size/type should be cleaned can be calculated.

The associated sensor is monitored to determine the amount of material attached to the at least one ditch magnet (step 312). Typically, the sensor is zeroed after the system is installed in the wellbore outflow. The amount of metal debris accumulated can calculated on an ongoing basis. For example, some systems calculate the weight of accumulated debris ($W_d$) using the following formula $$W_d = W_m - \varepsilon_s - \varepsilon_d - \varepsilon_\theta$$

where $W_m$ is weight measured by the load cell, $\varepsilon_s$ is a correction for change in weight of mud above the magnet as a function of mud level, where $\varepsilon_d$ is a correction for change in flow-induced vertical forces as a function of mud weight and mud velocity, and $\varepsilon_\theta$ is a correction for change in angle of sling as a function of sling inclination. Typically, $\varepsilon_s$, $\varepsilon_d$, and $\varepsilon_\theta$ are expected to be negligible. If the load-cell is zeroed immediately after installation, $\varepsilon_s$, $\varepsilon_d$, and $\varepsilon_\theta$ are effectively zero, if conditions don't change.

The amount of metal debris can be tracked over time. A relatively flat trend indicates no change in weight, implying negligible metal contaminants. A small steady uptrend indicates a small steady stream of metal contaminants. A relatively steep slope indicates a rapid change in weight, i.e., a surge in metal contaminants. For example, the rate of debris collected for casing exits is anticipated to be fairly constant as the window is milled out. If the volume increases, it can indicate a failed exit and drilling suspended. In addition, the mass of metal that should be recovered can be estimated. If the actual mass of metal exceeds this estimate, it is likely that something other than the casing intended has been drilled. This failure to exit is sometimes called 'tracking' where the casing mill tracks the original bore. This can lead to problems with the next assembly run in hole.

An alert is triggered when the amount of material attached to the at least one ditch magnet passes a threshold value (e.g., weight exceeds a threshold or resistance drops below a threshold value (step 314). The alert can result in cleaning of the ditch magnet(s) by removing them from the drilling mud, rinsing them with water, and wiping them down.

Figure 4:
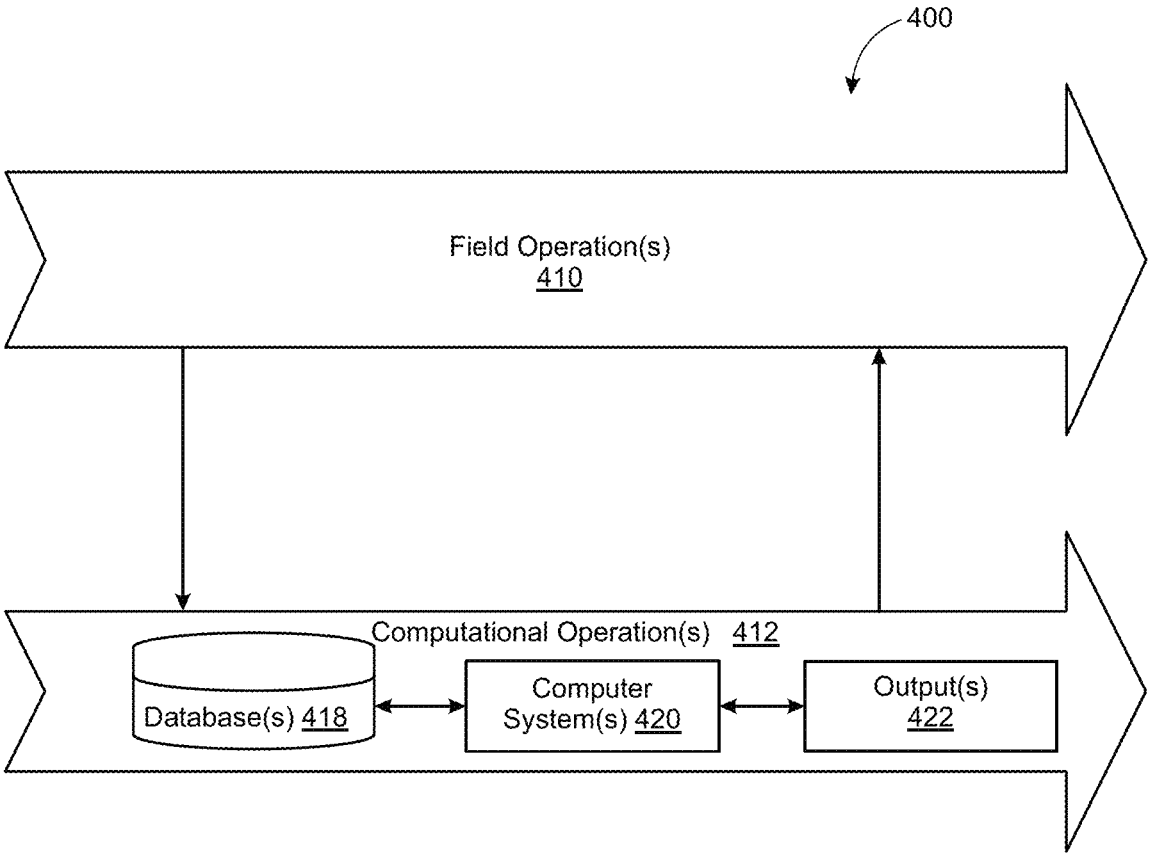
FIG. 4 illustrates hydrocarbon production operations that include both one or more field operations and one or more computational operations, which exchange information and control exploration for the production of hydrocarbons.

FIG. 4 illustrates hydrocarbon production operations 400 that include both one or more field operations 410 and one or more computational operations 412, which exchange information and control exploration for the production of hydrocarbons. In some implementations, outputs of techniques of the present disclosure can be performed before, during, or in combination with the hydrocarbon production operations 400, specifically, for example, either as field operations 410 or computational operations 412, or both.

Examples of field operations 410 include forming/drilling a wellbore, hydraulic fracturing, producing through the wellbore, injecting fluids (such as water) through the wellbore, to name a few. In some implementations, methods of the present disclosure can trigger or control the field operations 410. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 410 and responsively triggering the field operations 410 including, for example, generating plans and signals that provide feedback to and control physical components of the field operations 410. Alternatively or in addition, the field operations 410 can trigger the methods of the present disclosure. For example, implementing physical components (including, for example, hardware, such as sensors) deployed in the field operations 410 can generate plans and signals that can be provided as input or feedback (or both) to the methods of the present disclosure.

Examples of computational operations 412 include one or more computer systems 420 that include one or more processors and computer-readable media (e.g., non-transitory computer-readable media) operatively coupled to the one or more processors to execute computer operations to perform the methods of the present disclosure. The computational operations 412 can be implemented using one or more databases 418, which store data received from the field operations 410 and/or generated internally within the computational operations 412 (e.g., by implementing the methods of the present disclosure) or both. For example, the one or more computer systems 420 process inputs from the field operations 410 to assess conditions in the physical world, the outputs of which are stored in the databases 418. For example, seismic sensors of the field operations 410 can be used to perform a seismic survey to map subsurface features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 412 where they are stored in the databases 418 and analyzed by the one or more computer systems 420.

In some implementations, one or more outputs 422 generated by the one or more computer systems 420 can be provided as feedback/input to the field operations 410 (either as direct input or stored in the databases 418). The field operations 410 can use the feedback/input to control physical components used to perform the field operations 410 in the real world.

For example, the computational operations 412 can process the seismic data to generate three-dimensional (3D) maps of the subsurface formation. The computational operations 412 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 412 to process new information about the formation and control the drilling to adjust to the observed conditions in real-time.

The one or more computer systems 420 can update the 3D maps of the subsurface formation as information from one exploration well is received and the computational operations 412 can adjust the location of the next exploration well based on the updated 3D maps. Similarly, the data received from production operations can be used by the computational operations 412 to control components of the production operations. For example, production well and pipeline data can be analyzed to predict slugging in pipelines leading to a refinery and the computational operations 412 can control machine operated valves upstream of the refinery to reduce the likelihood of plant disruptions that run the risk of taking the plant offline.

In some implementations of the computational operations 412, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 5:
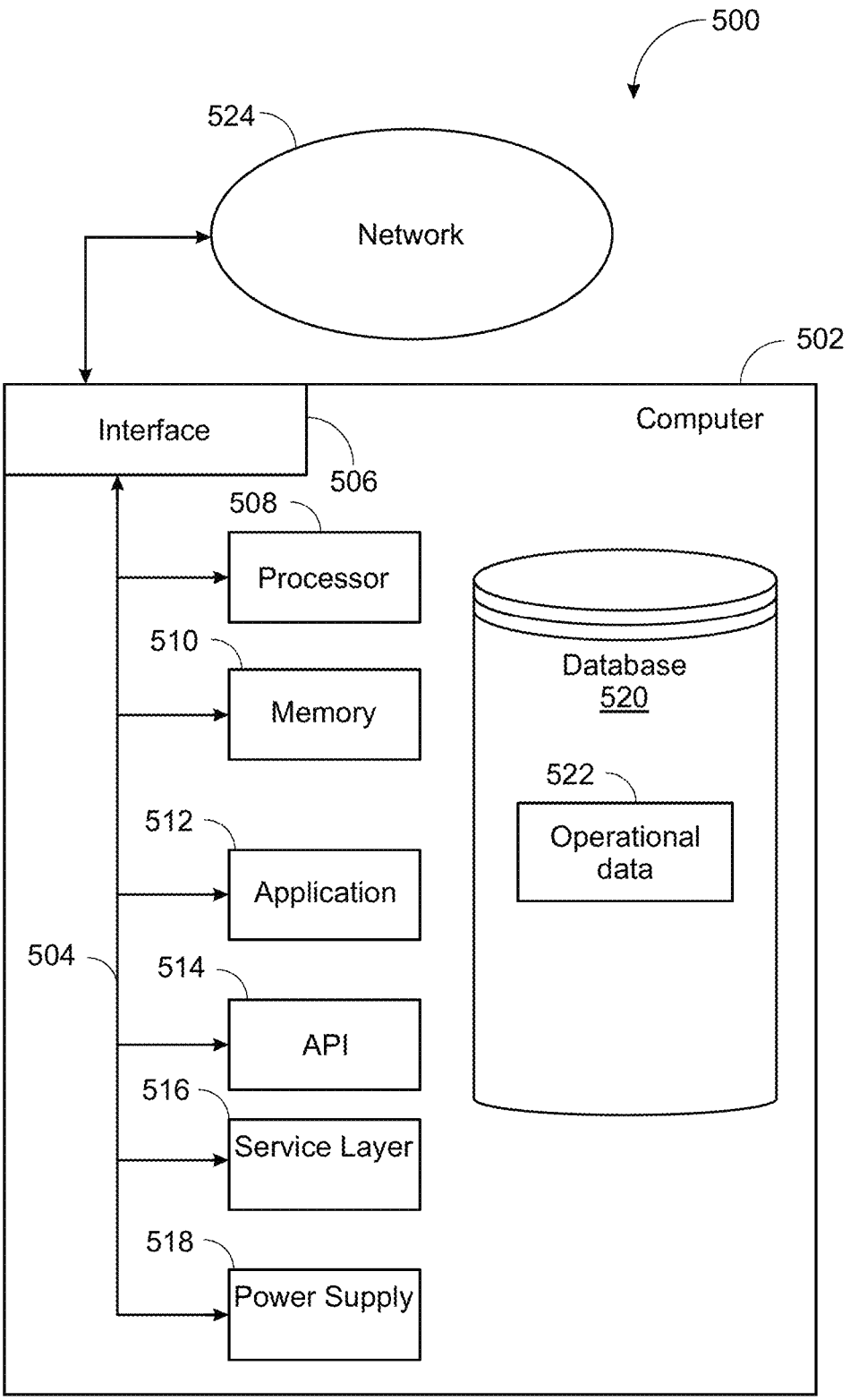
FIG. 5 is a block diagram illustrating an example computer system used to provide computational functionalities associated with described algorithms, methods, functions, processes, flows, and procedures according to some implementations of the present disclosure.

FIG. 5 is a block diagram of an example data processing system 500 used to provide computational functionalities associated with described algorithms, methods, functions, processes, flows, and procedures described in the present disclosure. For example, the data processing system 500 can be configured to implement the method 300 described with respect to FIG. 3. The data processing device 502 can include input devices such as keypads, keyboards, and touch screens that can accept user information. Also, the data processing device 502 can include output devices that can convey information associated with the operation of the data processing device 502. The information can include digital data, visual data, audio information, or a combination of information. The information can be presented in a graphical user interface (UI) (or GUI).

The data processing device 502 can serve in a role as a client, a network component, a server, a database, a persistency, or components of a computer system for performing the subject matter described in the present disclosure. The illustrated data processing device 502 is communicably coupled with a network 524. In some implementations, one or more components of the data processing device 502 can be configured to operate within different environments, including cloud-computing-based environments, local environments, global environments, and combinations of environments.

The data processing device 502 can receive requests over network 524 from a client application (for example, executing on another data processing device 502). The data processing device 502 can respond to the received requests by processing the received requests using software applications. Requests can also be sent to the data processing device 502 from internal users (for example, from a command console), external (or third) parties, automated applications, entities, individuals, systems, and computers.

Each of the components of the data processing device 502 can communicate using a system bus 504. In some implementations, any or all of the components of the data processing device 502, including hardware or software components, can interface with each other or the interface 506 (or a combination of both), over the system bus 504. Interfaces can use an application programming interface (API) 514, a service layer 516, or a combination of the API 514 and service layer 516. The API 514 can include specifications for routines, data structures, and object classes. The API 514 can be either computer-language independent or dependent. The API 514 can refer to a complete interface, a single function, or a set of APIs.

The service layer 516 can provide software services to the data processing device 502 and other components (whether illustrated or not) that are communicably coupled to the data processing device 502. The functionality of the data processing device 502 can be accessible for all service consumers using this service layer. Software services, such as those provided by the service layer 516, can provide reusable, defined functionalities through a defined interface. For example, the interface can be software written in JAVA, C++, or a language providing data in extensible markup language (XML) format. While illustrated as an integrated component of the data processing device 502, in alternative implementations, the API 514 or the service layer 516 can be stand-alone components in relation to other components of the data processing device 502 and other components communicably coupled to the data processing device 502. Moreover, any or all parts of the API 514 or the service layer 516 can be implemented as child or sub-modules of another software module, enterprise application, or hardware module without departing from the scope of the present disclosure.

The data processing device 502 includes an interface 506. Although illustrated as a single interface 506 in FIG. 5, two or more interfaces 506 can be used according to implementations of the data processing device 502 and the described functionality. The interface 506 can be used by the data processing device 502 for communicating with other systems that are connected to the network 524 (whether illustrated or not) in a distributed environment. Generally, the interface 506 can include, or be implemented using, logic encoded in software or hardware (or a combination of software and hardware) operable to communicate with the network 524. More specifically, the interface 506 can include software supporting one or more communication protocols associated with communications. As such, the network 524 or the interface's hardware can be operable to communicate physical signals within and outside of the illustrated data processing device 502.

The data processing device 502 includes a processor 508. Although illustrated as a single processor 508 in FIG. 5, two or more processors 508 can be used according to implementations of the data processing device 502 and the described functionality. Generally, the processor 508 can execute instructions and can manipulate data to perform the operations of the data processing device 502, including operations using algorithms, methods, functions, processes, flows, and procedures as described in the present disclosure.

The data processing device 502 also includes a database 520 that can hold data (such as threshold weights, load cell readings, resistances, and other operational data 522) for the data processing device 502 and other components connected to the network 524 (whether illustrated or not). For example, database 520 can be in-memory or a database storing data consistent with the present disclosure. In some implementations, database 520 can be a combination of two or more different database types (for example, hybrid in-memory and conventional databases) according to implementations of the data processing device 502 and the described functionality. While database 520 is illustrated as an internal component of the data processing device 502, in alternative implementations, database 520 can be external to the data processing device 502.

The data processing device 502 also includes a memory 510 that can hold data for the data processing device 502 or a combination of components connected to the network 524 (whether illustrated or not). In some implementations, memory 510 can be a combination of two or more different types of memory (for example, a combination of semiconductor and magnetic storage) according to implementations of the data processing device 502 and the described functionality. While memory 510 is illustrated as an internal component of the data processing device 502, in alternative implementations, memory 510 can be external to the data processing device 502.

The application 512 can be an algorithmic software engine providing functionality according to implementations of the data processing device 502 and the described functionality. For example, application 512 can serve as one or more components, modules, or applications.

The data processing device 502 can also include a power supply 518. The power supply 518 can include a rechargeable or non-rechargeable battery that can be configured to be either user- or non-user-replaceable.

There can be any number of computers 502 associated with, or external to, a computer system including the data processing device 502, with each data processing device 502 communicating over network 524. Further, the terms "client," "user," and other appropriate terminology can be used interchangeably, as appropriate, without departing from the scope of the present disclosure. Moreover, the present disclosure contemplates that many users can use one data processing device 502 and one user can use multiple computers 502.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based).

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random-access memory (RAM), read only memory (ROM), phase change memory (PRAM), static random-access memory (SRAM), dynamic random-access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

EXAMPLES

In some implementations, systems for monitoring and removing metal contaminants from drilling mud include: a ditch magnet; a sensor coupled to the ditch magnet, the sensor operable to measure at least one characteristic of the ditch magnet associated with an amount of metal material attached to the ditch magnet; and a computer system in electronic communication with the sensor comprising at least one processor and a memory storing instructions that when executed by the at least one processor causes performance of operations comprising: determining an amount of metal material attached to the ditch magnet based on the at least one characteristic of the ditch magnet; and triggering an alert when the amount of metal material attached to the ditch magnet exceeds a threshold value.

In some implementations, methods for monitoring and removing metal contaminants from drilling mud include: disposing a ditch magnet and a sensor in drilling mud, wherein the sensor is operable to measure at least one characteristic of the ditch magnet associated with an amount of metal material attached to the ditch magnet; using a computer system in electronic communication with the sensor, determining an amount of metal material attached to the ditch magnet based on the at least one characteristic of the ditch magnet; and using the computer system, triggering an alert when the amount of metal material attached to the ditch magnet exceeds a threshold value.

In an example implementation combinable with any other example implementation, the ditch magnet comprises plates on opposite ends of a central body and the sensor comprises an electrical circuit measuring electrical resistance between the plates.

In an example implementation combinable with any other example implementation, the sensor comprises a load cell. In some cases, the ditch magnet is suspended from the load cell. In some cases, the ditch magnet comprises plates on opposite ends of a central body and the sensor further comprises an electrical circuit measuring electrical resistance between the plates.

In an example implementation combinable with any other example implementation, the operations further comprise tracking a rate of change in the amount of metal material attached to the ditch magnet. In some cases, the operations further comprise providing input to drilling operations.

In an example implementation combinable with any other example implementation, the ditch magnet is one of a plurality of ditch magnets. In some cases, the sensor is one of a plurality of sensors. In some cases, each ditch magnet of the plurality of ditch magnets is associated with at least one of the plurality of sensors.

A number of embodiments of the systems and methods have been described. Nevertheless, it will be understood that various modifications may be made without departing from the spirit and scope of this specification. Accordingly, other embodiments are within the scope of the following claims.

What is claimed is:

1. A system for monitoring and removing metal contaminants from drilling mud, the system comprising:

a ditch magnet;

a sensor coupled to the ditch magnet, the sensor operable to measure at least one characteristic of the ditch magnet associated with an amount of metal material attached to the ditch magnet;

a computer system in electronic communication with the sensor comprising at least one processor and a memory storing instructions that when executed by the at least one processor causes performance of operations comprising:

determining an amount of metal material attached to the ditch magnet based on the at least one characteristic of the ditch magnet; and triggering an alert when the amount of metal material attached to the ditch magnet exceeds a threshold value;

wherein the ditch magnet comprises plates on opposite ends of a central body and the sensor comprises an electrical circuit measuring electrical resistance between the plates.

2. The system of claim 1, wherein the operations further comprise tracking a rate of change in the amount of metal material attached to the ditch magnet.

3. The system of claim 2, wherein the operations further comprise providing input to drilling operations.

4. The system of claim 1, wherein the ditch magnet is one of a plurality of ditch magnets.

5. The system of claim 4, wherein the sensor is one of a plurality of sensors.

6. The system of claim 5, wherein each ditch magnet of the plurality of ditch magnets is associated with at least one of the plurality of sensors.

7. A system for monitoring and removing metal contaminants from drilling mud, the system comprising:

a ditch magnet;

a sensor coupled to the ditch magnet, the sensor operable to measure at least one characteristic of the ditch magnet associated with an amount of metal material attached to the ditch magnet;

a computer system in electronic communication with the sensor comprising at least one processor and a memory storing instructions that when executed by the at least one processor causes performance of operations comprising:

determining an amount of metal material attached to the ditch magnet based on the at least one characteristic of the ditch magnet; and triggering an alert when the amount of metal material attached to the ditch magnet exceeds a threshold value;

wherein the sensor comprises a load cell; and wherein the ditch magnet is suspended from the load cell.

8. A method for monitoring and removing metal contaminants from drilling mud, the method comprising:

disposing a ditch magnet and a sensor in drilling mud, wherein the sensor is operable to measure at least one characteristic of the ditch magnet associated with an amount of metal material attached to the ditch magnet;

using a computer system in electronic communication with the sensor, determining an amount of metal material attached to the ditch magnet based on the at least one characteristic of the ditch magnet; and using the computer system, triggering an alert when the amount of metal material attached to the ditch magnet exceeds a threshold value;

wherein the ditch magnet comprises plates on opposite ends of a central body and the sensor comprises an electrical circuit measuring electrical resistance between the plates.

9. The method of claim 8, wherein the operations further comprise tracking a rate of change in the amount of metal material attached to the ditch magnet.

10. The method of claim 9, wherein the operations further comprise providing input to drilling operations.

11. The method of claim 8, wherein the ditch magnet is one of a plurality of ditch magnets.

12. The method of claim 11, wherein the sensor is one of a plurality of sensors.

13. The method of claim 12, wherein each ditch magnet of the plurality of ditch magnets is associated with at least one of the plurality of sensors.

14. A method for monitoring and removing metal contaminants from drilling mud, the method comprising:

disposing a ditch magnet and a sensor in drilling mud, wherein the sensor is operable to measure at least one characteristic of the ditch magnet associated with an amount of metal material attached to the ditch magnet;

using a computer system in electronic communication with the sensor, determining an amount of metal material attached to the ditch magnet based on the at least one characteristic of the ditch magnet; and using the computer system, triggering an alert when the amount of metal material attached to the ditch magnet exceeds a threshold value;

wherein the sensor comprises a load cell; and wherein the ditch magnet is suspended from the load cell.

* * * * *